US008596068B2

(12) United States Patent
Staffend

(10) Patent No.: US 8,596,068 B2
(45) Date of Patent: Dec. 3, 2013

(54) HIGH EFFICIENCY THERMODYNAMIC SYSTEM

(76) Inventor: Gilbert Staffend, Farmington, MI (US)

( * ) Notice: Subject to any disclaimer, the term of this patent is extended or adjusted under 35 U.S.C. 154(b) by 347 days.

(21) Appl. No.: 12/917,064

(22) Filed: Nov. 1, 2010

(65) Prior Publication Data

US 2011/0100011 A1 May 5, 2011

Related U.S. Application Data

(60) Provisional application No. 61/256,559, filed on Oct. 30, 2009.

(51) Int. Cl.
*F01K 23/06* (2006.01)

(52) U.S. Cl.
USPC ..... 60/670; 60/620; 60/623

(58) Field of Classification Search
USPC ..... 60/39.01, 670, 660, 650, 682, 519; 418/7, 13, 24, 27, 215, 228, 29, 211, 418/217, 219, 221; 127/227, 231, 236, 241, 127/243
See application file for complete search history.

(56) References Cited

U.S. PATENT DOCUMENTS 3,686,893 A * 8/1972 Edwards ..... 62/402
3,904,327 A * 9/1975 Edwards et al. ..... 418/8
4,009,573 A * 3/1977 Satz ..... 60/519
4,088,426 A 5/1978 Edwards
4,347,711 A 9/1982 Noe et al.
4,357,800 A * 11/1982 Hecker ..... 60/519
4,361,204 A 11/1982 Earle
4,793,832 A * 12/1988 Veltman et al. ..... 95/14
4,898,526 A 2/1990 Sakamaki et al.
5,722,229 A 3/1998 Provost
6,523,347 B1 2/2003 Jimov et al.
6,606,850 B2 8/2003 Logvinov et al.

(Continued)

FOREIGN PATENT DOCUMENTS

JP 63166619 A * 7/1988

OTHER PUBLICATIONS

Driver et al., A Rotary Positive Displacement Heat Pump Compressor and Turbine Combined in One Rotor, (1996). International Compressor Engineering Conference. Paper 1181. http://docs.lib.purdue.edu/icec/1181.

(Continued)

*Primary Examiner* — Kenneth Bomberg
*Assistant Examiner* — Philip Eklem

(57) ABSTRACT

An air aspirated hybrid heat pump and heat engine system (20) for selectively heating and cooling a space (22) having an flow path (24) including a compressor (76), a heat exchanger (32), an expander (78), and a generator (68). A combustion chamber (62) is in the flow path (24) for combusting a fuel in the air during a high heating mode. The heat exchanger (32) dissipates the heat from the air, and the expander (78) depressurizes the air while powering the generator (68). Also included is a positive displacement rotating vane-type device (36) having a stator housing (38) extending between longitudinal ends (40). A compression chamber inlet (52) and an expansion chamber outlet (58) are located on opposite longitudinal ends (40) of the stator housing (38) to be in simultaneous communication with the same chamber (48, 50)). A fluid enters the device through the compression chamber inlet (52) and pushes fluid out of the expansion chamber outlet (58).

19 Claims, 5 Drawing Sheets

(56) References Cited

U.S. PATENT DOCUMENTS

| | | | |
|---|---|---|---|
| 7,124,585 | B2 | 10/2006 | Kim et al. |
| 7,416,137 | B2 | 8/2008 | Hagen et al. |
| 7,556,015 | B2 | 7/2009 | Staffend |
| 2006/0236715 | A1 | 10/2006 | Nikai et al. |
| 2010/0050628 | A1 | 3/2010 | Staffend et al. |

OTHER PUBLICATIONS

Fischer, Feasibility Study and Hardware Design of A Pivoting-Tip Rotary-Vane Compressor and Expander Applied to a Solar-Driven Heat Pump (1978). International Compressor Engineering Conference. Paper 271. http://docs.lib.purdue.edu/icec/271.

* cited by examiner

HIGH EFFICIENCY THERMODYNAMIC SYSTEM

CROSS REFERENCE TO RELATED APPLICATION

This application claims the benefit of U.S. Provisional Application Ser. No. 61/256,559 filed Oct. 30, 2009.

BACKGROUND OF THE INVENTION

1. Field of the Invention

A thermodynamic heat pump and heat engine system for selectively heating and cooling a target space, and more particularly such a thermodynamic system in which ambient air comprises the working fluid therefor.

2. Description of the Prior Art

Thermodynamic systems in the form of heat pumps are used in the prior art to alternatively heat or cool a target space in standard heating/cooling modes. Heat pumps generally include a compressor, two heat exchangers, and an expander all disposed in a common fluid flow path. Most heat pump systems are of the closed loop type in which the working fluid, typically a two-phase refrigerant, is circulated through the system so as to absorb heat through one of the heat exchangers and to reject heat from the other heat exchanger. When the target space is to be heated, the system is configured so that the heat exchanger that rejects heat will be stationed in the target space or in thermodynamic communication therewith such as via suitable plumping or ducting. Alternatively, when the target space is to be cooled, the system is configured so that the heat exchanger that rejects heat will be stationed in (or ducted to) the ambient environment or other suitable heat sink. Both configurations are considered within a standard heating/cooling mode. Not all heat pump systems are of the closed loop type; some heat pump systems have been proposed in an open-loop arrangement using ambient air as the working fluid.

A target space may be any enclosed or localized space. The target space may be a human environment, such as a building or the passenger compartment in an automobile. Alternatively, the target space may be a relatively small or large area for objects like a personal computer enclosure or a server room.

While such known heat pump systems are adequate in many climates, they are frequently unable to provide adequate heating during extremely cold conditions. This is because a typically sized system is not capable of cooling the working fluid (even in the case of a hazardous refrigerant) to a cold enough temperature so that it has capacity to absorb heat from an exceptionally cold ambient atmosphere. In these conditions, it may be necessary to supplement the heat pump with a secondary furnace, stove, or other heating apparatus to adequately heat the target space.

U.S. Pat. No. 3,686,893, issued to Thomas C. Edwards on Aug. 29, 1972 and U.S. Pat. No. 4,008,426, issued to Thomas C. Edwards on May 9, 1978 (hereinafter referred to as "the Edwards patents"), show a positive displacement rotating vane-type device that operates a thermodynamic cycle for simultaneously compressing and expanding a working fluid which may be air. The devices shown in the Edwards patents each have a stator housing and a rotor disposed in the stator housing defining an interstitial space therebetween. A plurality of vanes are operatively disposed between the rotor and the stator housing for dividing the interstitial space into revolving compression and expansion chambers. The vanes are spring loaded to slidably engage the inner wall of the stator housing.

The rotor is rotatably disposed within the stator housing for rotating in a first direction. While the rotor is rotating, the vanes slide along the inner wall of the stator housing and simultaneously compress the working fluid in the compression chambers and expand the fluid in the expansion chambers.

The stator housing of the Edwards patents further define several ports for conducting the working fluid into and out of the device. These ports include a compression chamber inlet, a compression chamber outlet, an expansion chamber inlet, and an expansion chamber outlet. Additionally, the stator housing of the Edwards patents defines an expansion chamber inlet and an expansion chamber outlet. The compression chamber inlet and the expansion chamber outlet are both disposed on the side of the stator housing and communicate with different chambers. Thus, the working fluid enters and exits the device of the Edwards patents through various ports in a carefully arranged radial direction.

The Edwards patents are typical of prior art positive displacement rotating vane-type devices where the transfer of working fluid into and out of the device via ports is accomplished though localized piping that is arranged to prevent inadvertent mixing of high and low pressure fluids. Elaborate seals and other measures are sometimes taken to ensure the high and low pressure fluids never mix, and thereby reduce operating efficiencies. Such measures add considerably to the complexity and cost of positive displacement rotating vane-type devices.

There exists a need for further efficiency improvements in the field of heat pump systems, and more particularly for air-aspirated systems in which ambient air serves as the working fluid. There exists a need for a heat pump system that can fully meet the heating needs of a target space during very cold conditions. Furthermore, there exists a need for a heat pump system that is capable of efficiently transferring a working fluid (be it air or otherwise) between high and low pressure ports of a positive displacement rotating vane-type device without unnecessary complexity or cost.

SUMMARY OF THE INVENTION AND ADVANTAGES

According to a first aspect, the invention comprises an air aspirated, open-loop hybrid heat pump and heat engine system operable between a standard heating/cooling mode and a high heating mode. The system includes an integrated combustion chamber located in the flow path between a compressor and a heat exchanger for combusting a fuel directly in the air flow. In the standard heating/cooling mode, the combustion chamber lies in a dormant or inactive state while the heat pump system heats or cools the target space. In the high heating mode, however, the combustion chamber is activated to combust a fuel directly in the working fluid air, causing both the temperature and the pressure of the working fluid to increase dramatically. Heat added to the working fluid by the combustion process is dissipated to the target space through the heat exchanger thereby providing substantially increased heat output compared with the standard heating/cooling mode. The pressure created in the working fluid (air) by the combustion process and by the compressor is later expanded in an expander and ultimately returned to ambient. An energy receiving device, operably connected to the expander, converts at least some of the decreasing air pressure to a useable form of energy, such as electricity for example and/or mechanical energy that may be used to power the compressor. Thus, in the high heating mode, the energy added to the air in the compression and combustion processes is used to heat the target space while some or all of the pressure energy in the working fluid is reclaimed via the energy receiving device.

The system of the present invention enables a more efficient thermodynamic cycle than heat pumps of the prior art because it utilizes an air aspirated open loop configuration in combination with an integral combustion chamber that burns a fuel in the working fluid and combined with an energy receiving device that reclaims available pressure energy from the working fluid. As a result, the system is more readily adapted to heat a target space in extremely cold conditions and to conserve energy by harnessing at least some of the residual energy in the working fluid that exists in the form of a pressure differential above the ambient atmospheric conditions.

According to another aspect of this invention, a positive displacement rotating vane-type device includes a rotor rotatably supported within a stator housing. The stator housing has opposite longitudinal ends. A plurality of vanes are operatively disposed between the rotor and the stator housing and divide the interstitial space between the rotor and stator housing into a plurality of compression and expansion chambers, each chamber being defined by the space between adjacent vanes. As the rotor rotates relative to the stator housing, the chambers defined between adjacent vanes sequentially and progressively transition between compression and expansion stages in a continuum so that the working fluid is simultaneously compressed in compression chambers and expanded in expansion chambers. At least one transition point corresponds with maximum compression or maximum expansion of the working fluid where the chambers defined between adjacent vanes transition between the compression and expansion stages, respectively. A compression chamber port is located on one of the longitudinal ends of the stator housing and an expansion chamber port is located on the other of the longitudinal ends of the stator housing. The compression chamber port and the expansion chamber port are continuously in communication with at least one common chamber at or near a transition point. In operation, the working fluid enters the at least one common chamber through one of the compression and expansion chamber ports while urging the working fluid currently occupying the associated chamber axially outwardly out of the stator housing through the other of the compression and expansion chamber ports. The working fluid may be air, a multi-phase refrigerant, or other suitable substance. Working fluid occupying the common chamber at the transition point is thus moved out of the common chamber under the direct influence of incoming working fluid such that the incoming and outgoing working fluids are momentarily comingled. One benefit of this arrangement is an improved (less restricted) flow of working fluid through the system. Another benefit is that a greater fractional use can be made of the swept volume of the rotating vane-type device.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
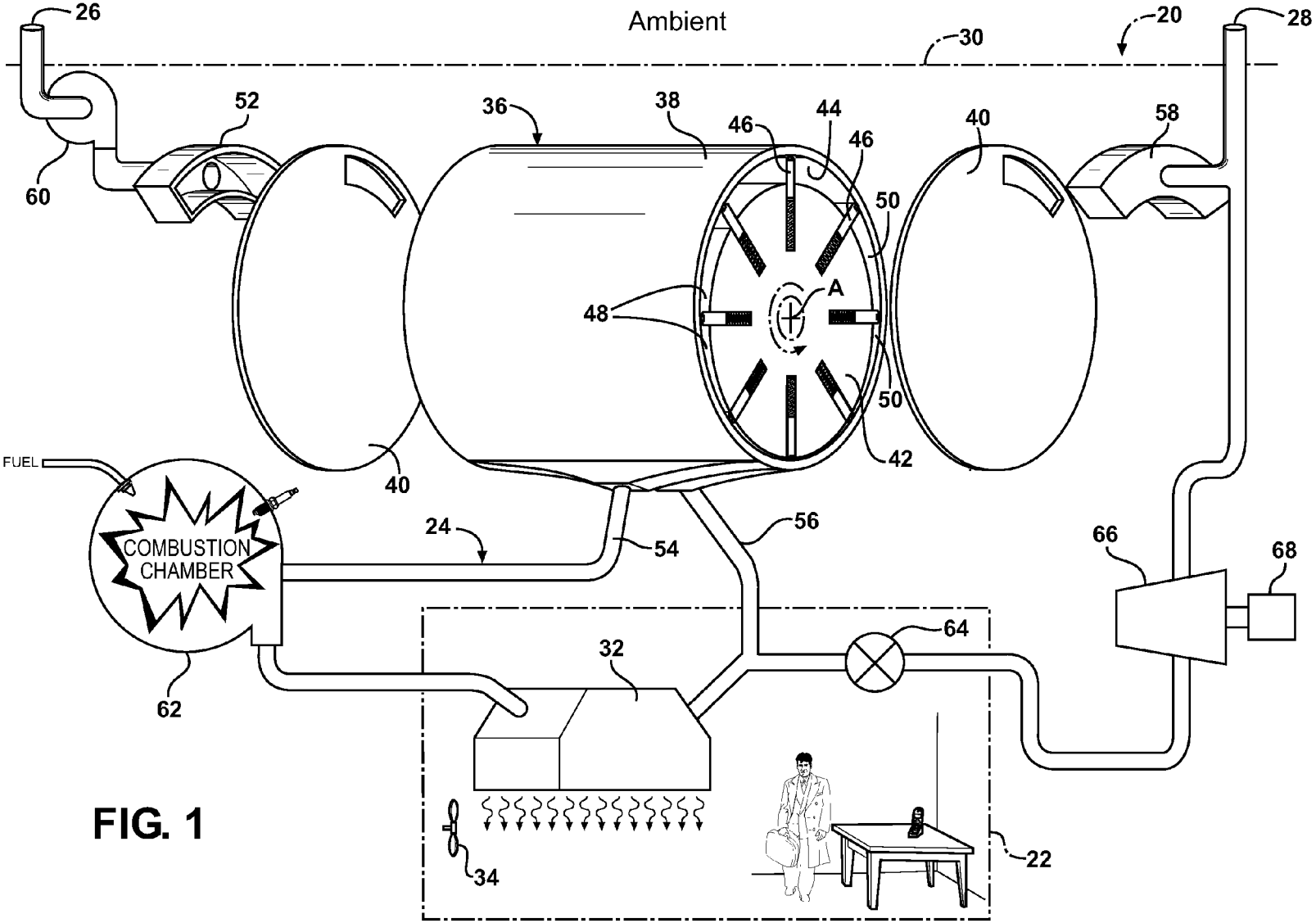
FIG. 1 is a view showing an air aspirated hybrid heat pump and heat engine system according to an embodiment of this invention.

Referring to the Figures, wherein like numerals indicate corresponding parts throughout the several views, one embodiment of the invention is shown in FIG. 1 as an open loop air aspirated hybrid heat pump and heat engine system 20 for selectively heating and cooling a target space 22. The target space 22 can be an interior room in a building, the passenger compartment of an automobile, a computer enclosure, or any other localized space to be heated and/or cooled. The working fluid of the system 20 in this embodiment is most preferably air, however in general the principles of this invention will permit other substances to be used for the working fluid including multi-phase refrigerants in suitable closed-loop configurations.

The hybrid heat pump and heat engine system 20 includes a working fluid (e.g., air) flow path 24, generally indicated in FIG. 1, extending from an inlet 26 to an outlet 28. The inlet 26 receives working fluid (air in this example) from an ambient source 30, while the outlet 28 discharges air from the system 20 back to the ambient environment 30. Preferably, the inlet 26 and outlet 28 are both disposed outside of the target space 22 and in the atmosphere 30 when atmospheric air is used as the working fluid.

A heat exchanger 32 is disposed in the flow path 24 between the inlet 26 and the outlet 28. In the exemplary embodiment of FIG. 1, the heat exchanger 32 is disposed in the target space 22 for transferring heat between the target space 22 and the working fluid in the flow path 24. In a standard heating/cooling mode of operation, the system 20 is configured to either transfer heat from the working fluid to the target space 22 to heat the target space 22 or alternatively to transfer heat from the target space 22 to the working fluid to cool the target space 22. The heat exchanger 32 is preferably a high efficiency heat exchanger 32 having a large surface area, such as by plurality of fins, for convectively transferring heat between air in the target space 22 and the working fluid in the flow path 24. Preferably, a fan 34 or a blower is disposed adjacent to the heat exchanger 32 for propelling the air in the target space 22 through the heat exchanger 32 to assist in the heat exchange between the air in the target space 22 and the air in the heat exchanger 32. Of course, conductive methods of heat transfer can also be used instead of or in addition to convective methods suggested by the fan 34 in the target space 22 in FIG. 1.

In the exemplary embodiment of FIG. 1, a positive displacement rotating vane-type device 36 is disposed in the flow path 24 for simultaneously compressing and expanding the air. While a positive displacement type device 36 is preferred for all implementations of this invention, some alternative embodiments of the invention as applied to the hybrid heat pump principles described below may substitute a blower that is not of the positive displacement variety in place of the positive displacement rotating vane-type device 36. Such substitution is enabled by the heat pump principles of this invention which deal with what can be considered a very low pressure ratio Brayton Cycle. As such, those of skill in the art will appreciate that a common fan or blower could be effective at maintaining a suitable pressure differential, namely on the order of Atmospheric plus or minus 20-30%. Of course, efficiently losses would be expected to be greater with common fan or blower devices, but such may be acceptable in certain applications.

The vane-type device 36 includes a generally cylindrical stator housing 38 longitudinally between spaced and opposite ends 40. A rotor 42 is disposed within the stator housing 38 and establishes an interstitial space between the rotor 42 and the inner wall 44 of the stator housing 38. A plurality of vanes 46 are operatively disposed between the rotor 42 and the stator housing 38 for dividing the interstitial space into intermittent compression and expansion chambers 48, 50. The vanes 46 are spring loaded to slidably engage the inner wall 44 of the stator housing 38. Accordingly, the plurality of compression 48 and expansion 50 chambers are each defined by a space between two adjacent vanes 46. As the rotor 42 rotates relative to the stator housing 38, the chambers 48, 50 defined between adjacent vanes 46 sequentially and progressively transition between compression and expansion stages in a continuum so that the working fluid is simultaneously compressed in compression chambers and expanded in expansion chambers. That is to say, at any time during rotation of the rotor 42, working fluid is being compressed in one portion of the device 36 and expanded in another portion of the device 36.

Two arcuately spaced transition points correspond with maximum compression and maximum expansion of the working fluid. In the particular embodiment illustrated in FIG. 1, these transition points occur at the 12 o'clock and 6 o'clock positions of the stator housing 38, with the 12 o'clock position being the point of maximum expansion and the 6 o'clock position being the point of maximum compression. In alternative configurations of the rotary device 36, there may be only one transition point corresponding to either maximum compression or maximum expansion, such as in systems like that shown in FIG. 5 were the compression and expansion functions are carried out in separate devices. Or, there may be three or more transition points where a rotary device incorporates multiple lobes as shown for example in U.S. Pat. No. 7,556,015 to Staffend, issued Jul. 7, 2009, the entire disclosure of which is hereby incorporated by reference. In any case, therefore, the transition points may be defined as the rotary positions where the chambers 48, 50 between adjacent vanes 46 transition between the compression and expansion stages, respectively.

Working fluid ports are provided to move the working fluid into and out of the device 36. In the embodiment illustrated in FIG. 1, the ports include a compression chamber inlet 52, a compression chamber outlet 54, an expansion chamber inlet 56, and an expansion chamber outlet 58. The compression chamber inlet 52 and expansion chamber outlet 58 are located adjacent to the 12 o'clock position transition point corresponding to maximum expansion. By contrast, the expansion chamber inlet 56 and compression chamber outlet 54 are located adjacent to the 6 o'clock position transition point corresponding to maximum expansion. The compression chamber inlet 52 is in fluid communication with the inlet 26 for receiving the atmospheric air, and the expansion chamber outlet 58 is in fluid communication with the outlet 28 for discharging the air out of the flow path 24 to the atmosphere 30. The heat exchanger 32 is in fluid communication with the vane-type device 36 through the compression chamber outlet 54 and the expansion chamber inlet 56.

The compression chamber inlet 52 and the expansion chamber outlet 58 are generally longitudinally aligned with one another relative to the stator housing 38 for simultaneously communicating with the same chamber 48, 50. In other words, the compression chamber inlet 52 and the expansion chamber outlet 58 may be located on opposite longitudinal ends of the stator housing 38 so as to communicate simultaneously with a common chamber or chambers 48, 50. Thus a compression chamber port (inlet 52 in this example) and an expansion chamber port (outlet 58 in this example) are continuously in communication with at least one common chamber at or near a transition point. A pump 60 may be disposed in the flow path 24 between inlet 26 and the compression chamber inlet 52 for propelling the working fluid into the stator housing 38 through the compression chamber inlet 52. The arrangement of the ports according to this invention enable a greater fractional use of the swept volume of the rotating vane-type device. Furthermore, the flow of working fluid through the device 36 is improved.

The rotor 42 is rotatably disposed within the stator housing 38 for rotating in a first direction. While the rotor 42 is rotating, the vanes 46 slide along the inner wall 44 of the stator housing 38 and simultaneously reduce the volume of the compression chambers 48 and increase the volume of the expansion chambers 50. In the exemplary embodiment, vane-type device 36 accomplishes the simultaneous compression and expansion because the cross-section of the inner wall 44 of the stator housing 38 is circular and the rotor 42 rotates about an axis A that is off-set from the center of the circular inner wall 44. Alternatively, the stator housing 38 could be elliptically shaped and the rotor 42 could rotate about the center of the elliptical stator housing 38. Other configurations are of course possible, including those described in U.S. Pat. No. 7,556,015 as well as those described in priority document U.S. Provisional Application Ser. No. 61/256,559 filed Oct. 30, 2009, the entire disclosure of which is hereby incorporated by reference and relied upon.

The embodiment of FIG. 1 can operate in a standard heating/cooling mode or in an optional high heating mode. In the standard heating/cooling mode, the pump 60 propels atmospheric air into the vane-type device 36 through the compression chamber inlet 52. The temperature and pressure of the air both increase as the air is compressed in the compression chambers 48 before exiting the device 36 through the compression chamber outlet 54. The pressurized and warmed air flows passively through a dormant combustion chamber 62 and then to the heat exchanger 32 where it dispenses heat to warm the target space 22. Exiting the heat exchanger 32, the cooled but still pressurized air then flows back to the device 36 and enters the stator housing 38 via the expansion chamber inlet 56 at or near the 6 o'clock transition point. The air is directed into the next available expansion chamber 50 where is carried and swept in an expanding volume to depressurize, preferably back to the atmospheric pressure. Available pressure energy in the working fluid is thus released from the working fluid to act on the rotor 42 as a torque and thereby directly offset the energy required on the compression side of the rotor 42 working to simultaneously compress the working fluid in chambers 48.

Next, the air is pushed out of the vane-type device 36 through the expansion chamber outlet 58 by the air entering the vane-type device 36 through the compression chamber inlet 52. Finally, the air is discharged to the atmosphere 30 through the outlet 28. The difference in the pressure of the air entering the expansion chambers 50 and the atmospheric pressure represents potential energy. The expansion chambers 50 of the vane-type device 36 harness that potential energy and use it to provide power to the rotor 42.

The system includes a combustion chamber 62 in the flow path 24 between the compression chamber outlet 54 of the vane-type device 36 and the heat exchanger 32. During the standard heating/cooling mode, described above, the combustion chamber 62 remains dormant. However, during an optional high heating mode, a fuel introduced into the combustion chamber 62 is combusted, or burned, in the working fluid to greatly increase both its temperature and pressure within the flow path 24. The fuel may be any suitable type including for examples natural gas, propane, gasoline, methanol, grains, particulates or other combustible materials.

The compression chambers 48 of the vane-type device 36 compress the air by a first predetermined ratio, and the expansion chambers 50 of the vane-type device 36 expand the air by a second predetermined ratio. In the FIG. 1 embodiment, the first and second predetermined ratios are approximately equal to one another. When accounting for heat transfers and losses, the equal expansion/compression ratios are adequate to extract all available work energy from the fluid during the standard heating/cooling modes of operation. However, following the combustion of air in the combustion chamber 62 during the high heating mode, the pressure of the air in the flow path 24 is substantially elevated such that the vane-type device 36 cannot be expected to fully (or nearly fully) depressurize all of the air in the flow path 24 back to the atmospheric pressure. Therefore, a secondary expander 66 may be provided to receive surplus working fluid. The secondary expander 66 may be located downstream of a valve 64 disposed in a spur flow path adjoining the main flow path 24 extending between the heat exchanger 32 and the expansion chamber inlet 56. During the standard heating/cooling mode, the valve 64 may be closed to direct all of the working fluid in the flow path 24 from the heat exchanger 32 to the expansion chamber inlet 56. Although not shown, a pressure regulator may be included in the flow path 24 leading to the expansion chamber inlet 56, and the valve 64 may operate in conjunction with the pressure regulator to open when the pressure regulator reaches a maximum pressure threshold. During the high heating mode when excesses of pressure are generated in the working fluid, the valve 64 is manipulated (either automatically or manually) to direct a portion of the working fluid from the heat exchanger 32 to a secondary expander 66. The remaining portion of the working fluid travels to the expansion chamber inlet 56 as described above. Thus, in order to improve the energy efficiency of the system, it is advantageous to redirect at least some of the pressurized air from the heat exchanger 32 to the secondary expander 66, which is mechanically connected to an energy receiving device, here an electric generator 68, and there reclaimed. Preferably, all of the surplus working fluid, i.e., that portion of the working fluid that cannot be fully expanded to ambient pressure in the expansion chambers 50, is directed to the secondary expander 66 where potential energy in the working fluid is converted into another useful form of energy. The vane-type device 36 and the electric generator 68 work together to capture and convert any residual pressure energy remaining in the working fluid before it is discharged to ambient 30.

In operation, during the high heating mode, the pump 60 propels atmospheric air into the vane-type device 36 through the compression chamber inlet 52. The temperature and pressure of the air both increase as the air is compressed in the compression chambers 48. The pressurized and warmed air then exits the vane-type device 36 through the compression chamber outlet 54 and flows into the combustion chamber 62. In the combustion chamber 62, the fuel is mixed with the air and combusted to greatly increase the pressure and temperature of the air. The air then flows through the heat exchanger 32 where it dispenses heat to warm the target space 22. Next, the valve 64 directs a predetermined amount of the air to the expansion chamber inlet 56 of the vane-type device 36 and the remaining air to the secondary expander 66. In the vane-type device 36, the pressurized air is expanded, preferably to or nearly to the atmospheric pressure, before it is discharged out of the flow path 24 and to the atmosphere 30 through the outlet 28. A secondary heat exchanger (not shown) may be incorporated into the flow path 24 between the expansion chamber outlet 58 and the flow path outlet 28 to scavenge any remaining heat in the working fluid and thereby further increase thermodynamic efficiencies. Ideally, the temperature of the working fluid as it emerges from the outlet 28 is at or only very slightly greater than the ambient air temperature. The air in the secondary expander 66 is also expanded, preferably to or nearly to atmospheric pressure, while powering the generator 68 to produce electricity. After the air is expanded by the secondary expander 66, it is also directed to the outlet 28 to be discharged to the atmosphere 30.

Through reconfiguration, the embodiment of FIG. 1 can also work in a cooling capacity in its standard heating/cooling mode. There are many ways to reconfigure the system. One way to switch the system to the cooling operating mode is to rotate the vane-type device 36 by one hundred and eighty degrees (180°). In another technique, the rotor 42 could be moved in a radially upward direction (i.e., shifted upward) while the stator housing 38 remains stationary. Both of these reconfiguration methods effectively transform the compression chambers 48 into the expansion chambers 50 and vice versa. When operating in the cooling operating mode, the pump 60 first propels the atmospheric air into the expansion chambers 50 of the vane-type device 36 to reduce the pressure and temperature of the air. The combustion chamber 62 is dormant. The cooled air receives heat from the heat exchanger 32 to cool the target space 22. The air is then re-pressurized in the compression chambers 48 of the vane-type device 36, preferably to atmospheric pressure, before being dispensed to the atmosphere 30 through the outlet 28.

Figure 2:
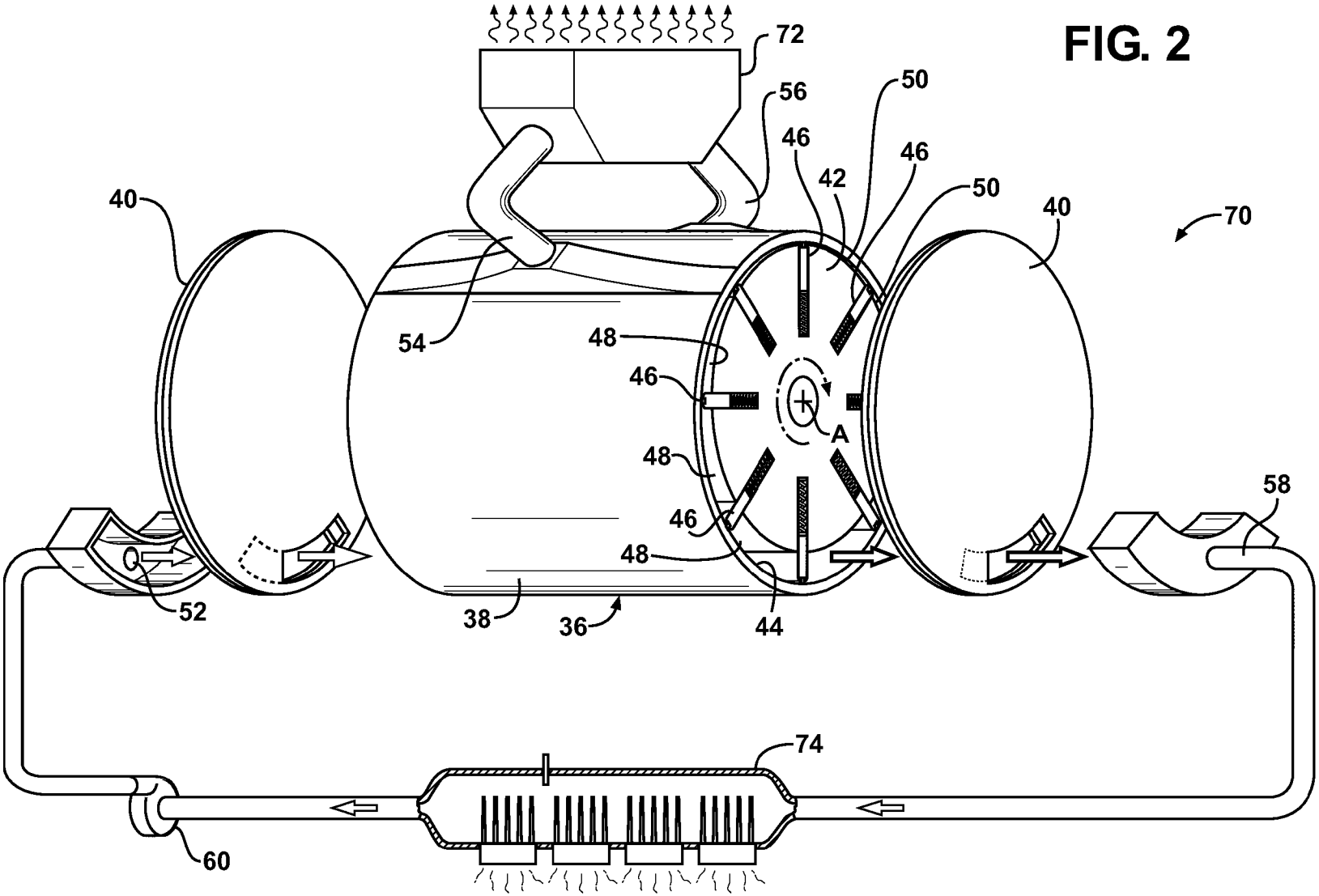
FIG. 2 is a simplified, partially exploded view of a positive displacement rotating vane-type device as in FIG. 1 but configured in a closed-loop arrangement.

The vane-type device 36 can also work in a closed loop system 70, as generally shown in FIG. 2. In the closed loop system 70, the working fluid may be air or a refrigerant. Like the open-loop system of FIG. 1, the compression chamber inlet 52 and expansion chamber outlet 58 are generally longitudinally aligned with one another for simultaneously communicating with the same chamber 48, 50. A high-pressure side heat exchanger 72 is fluidly connected to the vane-type device 36 through the compression chamber outlet 54 and the expansion chamber inlet 56. A low-pressure side heat exchanger 74 is fluidly connected to the vane-type device 36 through the expansion chamber outlet 58 and the compression chamber inlet 52.

The closed loop system 70 FIG. 2 has two operating modes: a first operating mode and a second operating mode. Either the high pressure side heat exchanger 72 or the low-pressure side heat exchanger 74 may be disposed in a target space to be selectively heated or cooled or outside of the target space in the atmosphere.

In the first operating mode, the rotor 42 rotates in a first direction, causing the pressure and temperature of the working fluid in the compression chambers 48 to increase as the volume of those compression chambers 48 decreases. That working fluid then flows into the high-pressure side heat exchanger 72 where it dissipates heat to either the target space or the atmosphere. The pressurized and cooled working fluid then flows into the expansion chambers 50 through the expansion chamber inlet 56. In the expansion chambers 50, the temperature and the pressure of the working fluid decrease as the volume of the expansion chambers 50 increases. The working fluid leaves the expansion chambers 50 through the expansion chamber outlet 58 and flows to the low-pressure side heat exchanger 74. In the low-pressure side heat exchanger 74, the working fluid receives heat from either the target space or the atmosphere before flowing back into the compression chambers 48.

Similar to the open loop embodiment of FIG. 1, the vane-type device 36 of FIG. 2 can be switched to the second operating mode through reconfiguring. Specifically, the vane-type device 36 can be rotated by one hundred and eighty degrees (180°), or the rotor 42 could be moved radially within the stator housing 38. This reconfiguring effectively reverses the functionality of the high-pressure side heat exchanger 72 and the low-pressure side heat exchanger 74. In other words, the low-pressure side heat exchanger 74 becomes the high-pressure side heat exchanger 72 and dissipates heat, and the high-pressure side heat exchanger 32, 72 becomes the low-pressure side heat exchanger 74 and receives heat.

Figure 3:
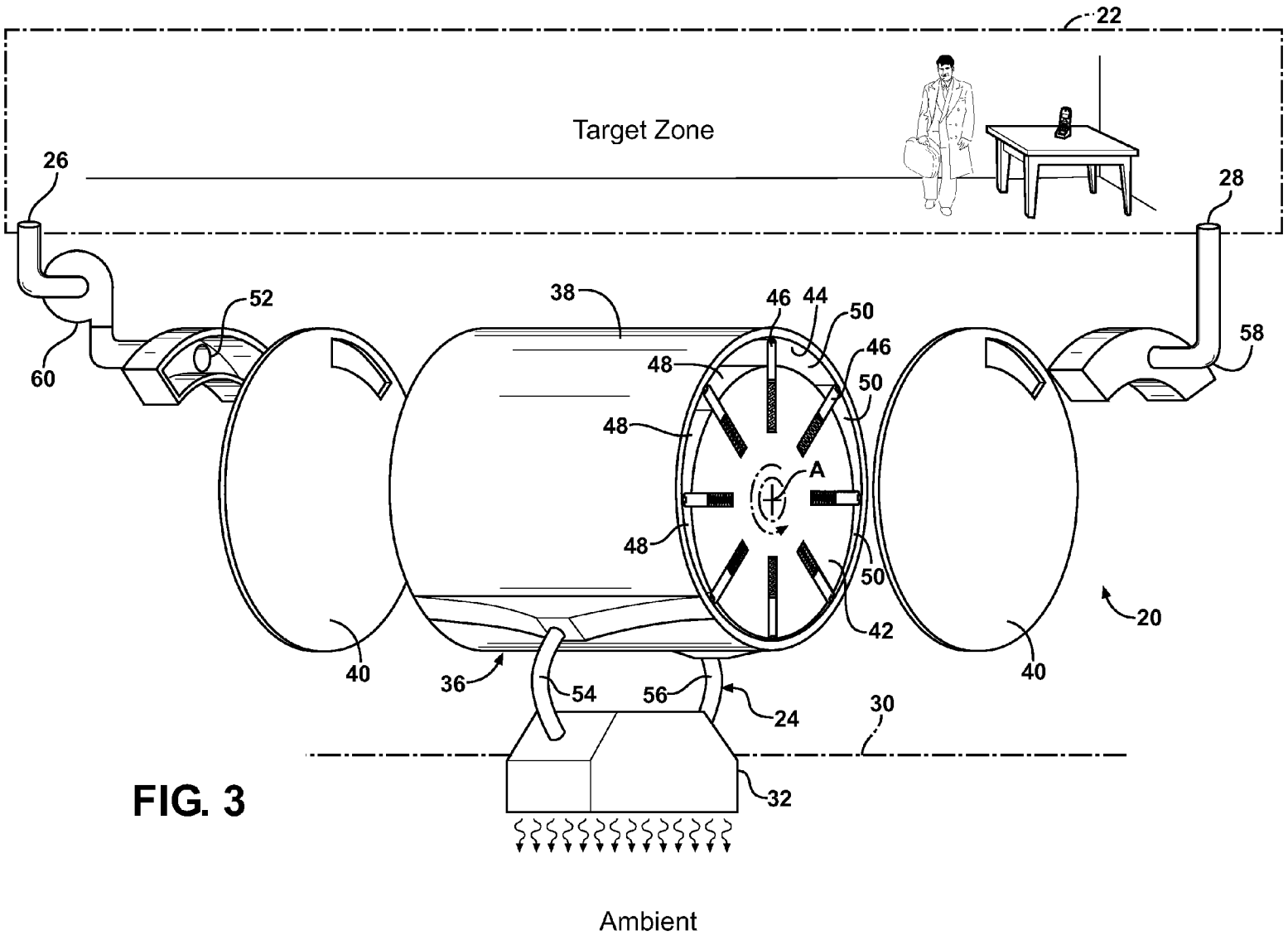
FIG. 3 shows an alternative embodiment of the invention wherein the positive displacement rotating vane-type device of FIG. 1 is configured in a cooling mode.

FIG. 3 shows the vane-type device 36 in a cooling open-loop system. Similar to the embodiment of FIG. 1, air is used as the working fluid in the embodiment of FIG. 3. Unlike the embodiment of FIG. 1, the inlet 26 and the outlet 28 are disposed in the target space 22 for using air from the target space 22 as the working fluid. In the embodiment of FIG. 3, the compression chamber inlet 52 of the stator housing 38 is generally longitudinally aligned with the expansion chamber outlet 58 of the stator housing 38. A heat exchanger 32 disposed in the atmosphere 30 is fluidly connected to the vane-type device 36 through the compression chamber outlet 54 and the expansion chamber inlet 56. In operation, the air in the target space 22 enters the flow path 24 through the inlet 26, and the blower propels the air into the vane-type device 36 through the compression chamber inlet 52. The pressure and temperature of the air increase as the volume of the compression chambers 48 decreases. The air leaves the vane-type device 36 through the compression chamber outlet 54 and flows to the heat exchanger 32. In the heat exchanger 32, the warmed and pressurized air dispenses heat to the atmosphere 30 before flowing back into the vane-type device 36 through the expansion chamber inlet 56. In the vane-type device 36, the pressure and temperature of the air decrease as the volume of the expansion chambers 50 increases. The air entering the vane-type device 36 then pushes the cooled and depressurized air out of the vane-type device 36 through the expansion chamber outlet 58. The air then exits the flow path 24 through the outlet 28 at a cooler temperature than it was when entering the flow path 24, thereby cooling the target space 22.

Figure 4:
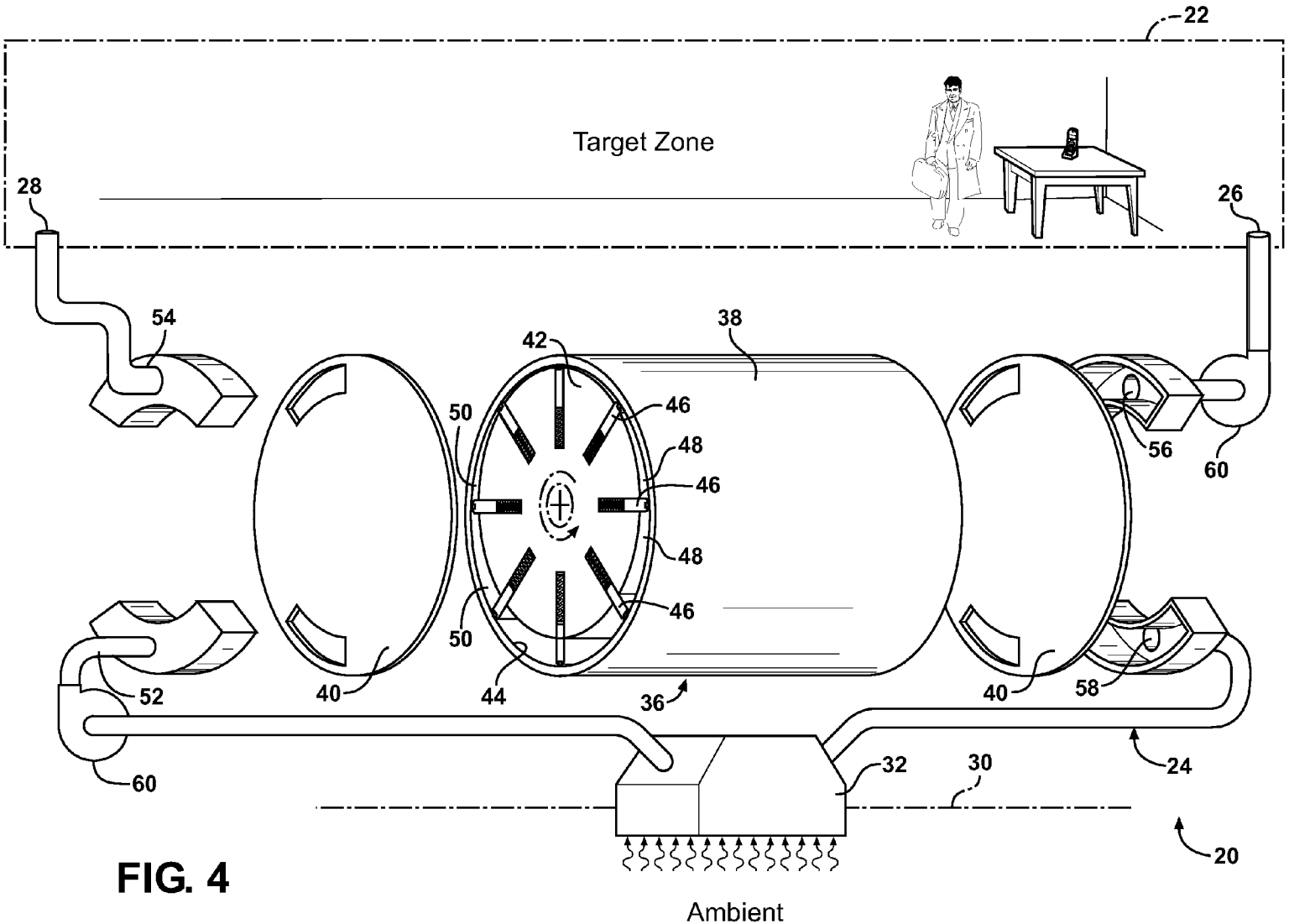
FIG. 4 is a view as in FIG. 3 but where the device is configured in a heating mode.

FIG. 4 shows the vane-type device 36 in a heating open loop system. Similar to the embodiment of FIG. 3, the inlet 26 and the outlet 28 are disposed in the target space 22 for using the air in the target space 22 as the working fluid. In the embodiment of FIG. 4, the expansion chamber inlet 56 of the stator housing 38 is generally longitudinally aligned with the compression chamber outlet 54 of the stator housing 38, and the compression chamber inlet 52 of the stator housing 38 is generally longitudinally aligned with the expansion chamber outlet 58 of the stator housing 38. A heat exchanger 32 disposed in the atmosphere 30 is fluidly connected to the expansion chamber outlet 58 and the compression chamber inlet 52. In operation, the air of the target space 22 enters the flow path 24 through the inlet 26, and the blower propels the air into the vane-type device 36 through the expansion chamber inlet 56. The pressure and temperature of the air decrease as the volume of the expansion chambers 50 increases. The air leaves the vane-type device 36 through the expansion chamber outlet 58 and flows to the heat exchanger 32. In the heat exchanger 32, the cooled and depressurized air receives heat from the atmosphere 30 before being propelled back into the vane-type device 36 through the compression chamber inlet 52 by another pump 60. The warmed and still depressurized air entering the vane-type device 36 through the compression chamber inlet 52 also pushes the cooled and depressurized air out of the vane-type device 36 through the expansion chamber outlet 58. In the vane-type device 36, the pressure and temperature of the air increase as the volume of the compression chambers 48 decreases. The air entering the vane-type device 36 through the expansion chamber inlet 56 then pushes the warmed and re-pressurized air out of the vane-type device 36 through the compression chamber outlet 54. The air then exits the flow path 24 through the outlet 28 at a warmer temperature than it was when entering the flow path 24, thereby warming the target space 22.

Figure 5:
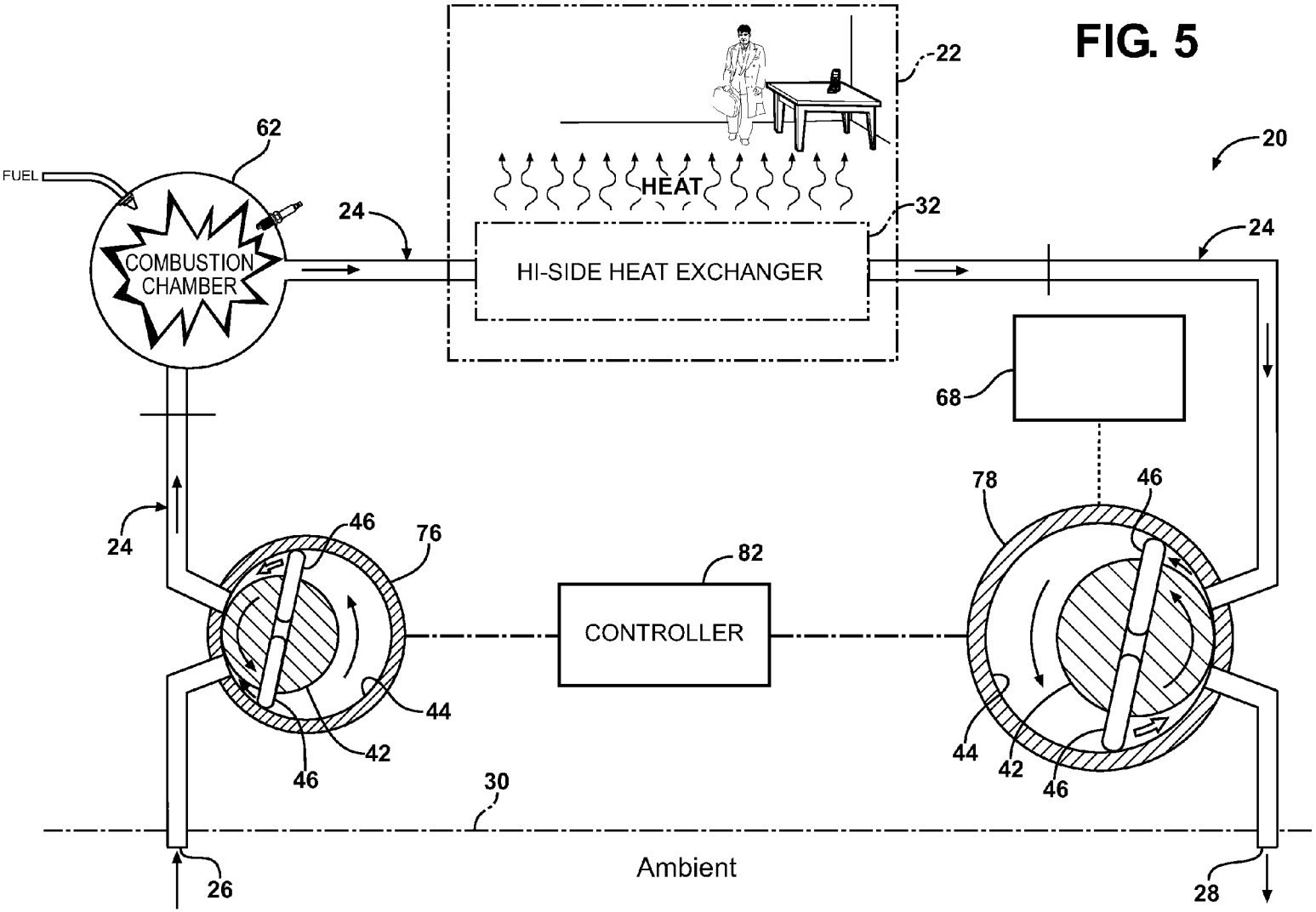
FIG. 5 is yet another alternative embodiment of the air aspirated hybrid heat pump and heat engine system utilizing independent compressor and expander devices to achieve either a fixed or variable asymmetric compression/expansion ratio.

An open-loop air aspirated hybrid heat pump and heat engine system 20 having a compressor 76 separated from the expander 78 is generally shown in FIG. 5. Similar to the embodiment of FIG. 1, atmospheric air is used as the working fluid in the embodiment of FIG. 5. In the embodiment of FIG. 5, the heat exchanger 32 is disposed in the target space 22 for transferring heat between the air in the flow path 24 and the target space 22, and the inlet 26 and the outlet 28 are disposed outside of the target space 22 in the atmosphere 30. A compressor 76 is disposed in the flow path 24 between the inlet 26 and the heat exchanger 32 for compressing and delivering the air from the inlet 26 to the heat exchanger 32. An expander 78 is disposed in the flow path 24 between the heat exchanger 32 and the outlet 28 for expanding (i.e. depressurizing) and delivering the air from the heat exchanger 32 to the outlet 28. In the exemplary embodiment, the compressor 76 and expander 78 are both vane-type pumps having a cylindrically shaped stator 38 and a rotor 42 rotatably disposed within the stator 38. A plurality of spring-loaded vanes 46 project outwardly from the rotor 42 to slidably engage the inner wall 44 of the stator 38. However, it should be appreciated that the compressor 76 and the expander 78 could be any type of pumps.

An energy receiving device is mechanically connected to the expander 78 for harnessing potential energy from the air in the flow path 24 as will be discussed in further detail below. In the exemplary embodiment, the energy receiving device is a generator 68 for generating electricity. The electricity can then be used immediately, stored in batteries or inserted into the power grid. Alternatively or additionally, the energy receiving device could be a mechanical connection between the expander 78 and the compressor 76 for powering the compressor 76 with the energy reclaimed from the air in the flow path 24. The energy receiving device could also be any other device for harnessing the energy produced by the expander 78.

A controller 82 is in communication with the compressor 76 and the expander 78 for controlling the hybrid heat pump and heat engine system 20. The controller 82 manipulates or switches the system 20 between different operating modes: a standard heating/cooling mode (in which the target space 22 can be either heated or cooled), and a high heating mode (in which the target space 22 is heated). The operating mode may be selected by a person, or the controller 82 can be coupled to a thermostat for automatically keeping the target space 22 at a desired temperature.

In reference to FIG. 5, the working fluid (e.g., air) travels through the flow path 24 in a clockwise direction. In the standard cooling operating mode, the controller 82 directs the compressor 76 to operate at a low speed and the expander 78 to operate at a higher speed. What follows is that the compressor 76 functions similarly to a valve separating the air downstream of the compressor 76 from the air at the inlet 26 of the flow path 24. The expander 78 then pulls the air along the flow path 24 by reducing the pressure of the air from the compressor 76 to the expander 78. Persons skilled in the art will appreciate that the temperature of the air leaving the compressor 76 will decrease as the pressure decreases. In other words, both the pressure and temperature of the air on the downstream side of the compressor 76 are reduced when compared to the pressure and temperature of the air at the inlet. The depressurized and cooled air then flows through the heat exchanger 32, which transfers heat from the target space 22 to the air in the flow path 24 to cool the target space 22. After leaving the heat exchanger 32, the expander 78 propels the air out of the flow path 24 through the outlet 28. Alternatively, the direction of the air may be reversed to flow in a counter-clockwise direction if this makes better use of the devices chosen with the final engineering targets in mind. In the cooling operating mode, the energy receiving device may be mechanically connected to the compressor 76 for harnessing the potential pressure energy from the air flowing through the compressor 76.

In the standard heating mode, the controller 82 directs the compressor 76 to compress the air from the inlet to increase the pressure and the temperature of the air, as will be understood by those skilled in the art. The pressurized and warmed air then flows through the flow path 24 to the heat exchanger 32. The heat exchanger 32 dispenses heat to the target space 22 to warm the target space 22. Although the air in the flow path 24 is cooled by the heat exchanger 32, the air remains pressurized when compared to the air entering the flow path 24. This difference in pressure represents potential energy, which can be harnessed. The generator 68, which is coupled to the expander 78, harnesses this potential energy while the expander 78 expands the pressurized air to reduce the pressure of the air. Preferably, the air is expanded back to the same pressure at which it entered the flow path 24. Following the expansion, the air is discharged from the flow path 24 through the outlet 28.

In the high heating mode, the compressor 76 receives air aspirated from the inlet 26 and then compresses the air to increase its pressure and also its temperature (in compliance with relevant thermodynamic gas laws). The pressurized and high temperature air then flows through the flow path 24 to the combustion chamber 62, which mixes a suitable fuel with the air and then combusts the mixture. The combustion of the fuel and air mixture further increases both the pressure and the temperature of the air in the flow path 24. The pressurized and heated air then flows through the heat exchanger 32 and dispenses heat to the target space 22. Air leaving the heat exchanger 32 in the high heating mode remains substantially highly pressurized relative to the ambient air pressure, and therefore represents a valuable amount of potential energy. The generator 68 maybe of any suitable type that is effective to convert this potential energy into another form, such as electricity and/or mechanical energy. This potential energy may be harnessed while the expander 78 expands the air to reduce the pressure of the air, or accumulated for conversion at a later time. In other words, any residual pressure energy put into the air through the initial compression and combustion processed is subsequently re-claimed by the generator 68. Once the potential energy has been reclaimed, the low pressure air is then discharged from the flow path 24 through the outlet 28 back into the environment 30.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| 20 | hybrid heat pump and heat engine system |
| 22 | space |
| 24 | air flow path |
| 26 | air inlet |
| 28 | air outlet |
| 30 | atmosphere |
| 32 | heat exchanger |
| 34 | fan |
| 36 | vane-type device |
| 38 | stator housing |
| 40 | ends |
| 42 | rotor |
| 44 | inner wall |
| 46 | vanes |
| 48 | compression chambers |
| 50 | expansion chambers |
| 52 | compression chamber inlet |
| 54 | compression chamber outlet |
| 56 | expansion chamber inlet |
| 58 | expansion chamber outlet |
| 60 | pump |
| 62 | combustion chamber |
| 64 | valve |
| 66 | secondary expander |
| 68 | generator |
| 70 | closed loop system |
| 72 | high-pressure side heat exchanger |
| 74 | low-pressure side heat exchanger |
| 76 | compressor |
| 78 | expander |
| 82 | controller |
| A | central axis |

What is claimed is:

1. An open-loop air aspirated hybrid heat pump and heat engine system (20) for selectively heating and cooling a target space (22) comprising:

a flow path (24) for a working fluid extending from an inlet (26) to an outlet (28), said inlet (26) disposed to receive ambient air as a working fluid and said outlet (28) disposed for expelling the air out of the flow path (24), a heat exchanger (32) in said flow path (24) between said inlet (26) and said outlet (28), said heat exchanger (32) disposed in thermodynamic communication with the target space (22) for transferring heat between the target space (22) and the air in said heat exchanger (32), a compressor (76) in said flow path (24) between said inlet (26) and said heat exchanger (32) for compressing and delivering the air from said inlet (26) to said heat exchanger (32), an expander (78) in said flow path (24) between said heat exchanger (32) and said outlet (28) for expanding and delivering the air from said heat exchanger (32) to said outlet (28), an energy receiving device mechanically connected to said expander (78) for harnessing energy from the air, a combustion chamber (62) in direct communication with said flow path (24) between said compressor (76) and said heat exchanger (32) for combusting a fuel in the air in said flow path (24), said combustion chamber (62) being selectively operable between a standard heating/cooling mode wherein said combustion chamber (62) remains dormant and a high heating mode wherein said combustion chamber (62) actively combusts a fuel with the air to further increase the pressure aid temperature of the air upstream of said heat exchanger (32), and further including a controller (82) in communication with said compressor (76) and said expander (78), said controller (82) having a standard cooling mode with said compressor (76) operating at a slow speed to direct the air through said flow path (24) and said expander (78) operating at a high speed to pull the air through said compressor (76) to reduce the pressure and the temperature of the air between the compressor (76) and the heat exchanger (32) and wherein said heat exchanger (32) transfers heat from the target space (22) to the air in the flow path (24) to cool the target space (22).

2. The air aspirated hybrid heat pump and heat engine system (20) as set forth in claim 1 wherein said energy receiving device is an electric generator (68) for generating electricity.

3. The air aspirated hybrid heat pump and heat engine system (20) as set forth in claim 1 wherein said compressor (76) and said expander (78) each comprise a positive displacement vane pump.

4. The air aspirated hybrid heat pump and heat engine system (20) as set forth in claim 1 wherein said compressor (76) and said expander (78) are contained within a vane-type positive displacement device (36) for simultaneously compressing and expanding the air in the flow path (24).

5. The air aspirated hybrid heat pump and heat engine system (20) as set forth in claim 4 wherein said vale-type device (36) defines a plurality of chambers (48, 50) intermittently switching, between compression chambers (48) and expansion chambers (50).

6. The air aspirated hybrid heat pump and heat engine system (20) as set forth in claim 5 further including a secondary expander (66) in fluidly parallel relationship with said expansion Chambers (50) of said vane-type device (36) for expanding the air from said heat exchanger (32).

7. The air aspirated hybrid heat pump and heat engine system (20) as set forth in claim 6 further including a generator (68) mechanically connected to said secondary expander (68) for generating electricity.

8. The air aspirated hybrid heat pump and heat engine system (20) as set forth in claim 1, wherein said compressor (76) and said expander (78) are contained within a common stator housing (38) having a central axis (A) and longitudinally spaced, opposite ends (40); a rotor (42) disposed within said stator housing (38) and establishing an interstitial space therebetween; a plurality of vanes (46) operatively disposed between said rotor (42) and said stator housing (38) for dividing said interstitial space into intermittent compression and expansion chambers (48, 50); said stator housing (38) defining a plurality of ports for conducting the working fluid to and from said stator housing (38), said ports including a compression chamber inlet (52) and a compression chamber outlet (54) and an expansion chamber inlet (56) and an expansion chamber outlet (58) each communicating with said interstitial space; said rotor (42) being rotatably disposed within said stator housing (38) for rotating in a first direction with said vanes (46) simultaneously compressing the working fluid in said chambers (48: 50) from said compression chamber inlet (52) to said compression chamber outlet (54) and expanding the fluid in said chambers (48, 50) from said expansion chamber inlet (56) to said expansion chamber outlet (58); and at least two of said ports being located opposite one another on respective said longitudinal ends (40) of said stator housing (38), said ports being generally longitudinally aligned for continuously simultaneously communicating with the same one of said chambers (48, 50) wherein the working fluid entering the associated chamber (48, 50) through one of said ports urges the working fluid currently occupying the associated chamber (48, 50) axially outwardly out of said stator housing (38) through the other of said ports.

9. A method for selectively heating and cooling a target space (22) comprising the steps of:

providing a flow path (24) having an inlet (26) for receiving a flow of air and an outlet (28) for expelling a flow of air, providing a compressor (76) in the flow path (24), providing an expander (78) in the flow path (24) between the compressor (76) and the outlet (28), providing a heat exchanger (32) in the flow path (24) between the compressor (76) and the expander (78), alternately cooling the target space (22) by transferring heat from the target space (22) to the air in the flow path (24) via the heat exchanger (32) and heating the target space (22) by transferring heat to the target space (22) from the air in the flow path (24) via the heat exchanger (32), said heating step including compressing the air with the compressor (76), rejecting heat from the pressurized air in the heat exchanger (32), then expanding the air with the expander (78), and then discharging the cooled and depressurized air from the flow path (24) through the outlet (28), and said heating step further including providing a combustion chamber (62) in the flow path (24) between the compressor (76) and the heat exchanger (32), mixing a fuel with the air in the combustion chamber (62), and combusting the fuel and the air in the combustion chamber (62) to further increase the pressure and temperature of the air upstream of the heat exchanger (32).

10. The method for selectively heating and cooling a space (22) as set forth in claim 9 further including the step of reclaiming energy from the air downstream of the heat exchanger (32).

11. The method for selectively heating and cooling a, space (22) as set forth in claim 10 wherein said step of reclaiming energy includes generating electricity.

12. The method for selectively heating and cooling a space (22) as set forth in claim 10 wherein said step of reclaiming energy includes applying a torque to the compressor (76).

13. A positive displacement rotating vane-type device (36) of the type operated in a thermodynamic cycle for simultaneously compressing and expanding a working fluid, said device comprising:

a stator housing (38) having a central axis (A) and longitudinally spaced opposite ends (40);

a rotor (42) disposed within said stator housing (38) and establishing an interstitial space therebetween;

a plurality of vanes (46) operatively disposed between said rotor (42) and said stator housing (38) for dividing said interstitial space into intermittent compression and expansion chambers (48, 50);

said stator housing (38) defining a plurality of ports for conducting the working fluid to and from said stator housing (38), said ports including a compression chamber inlet (52) and a compression chamber outlet, (54) and an expansion chamber inlet (56) and an expansion chamber outlet (58) each communicating with said interstitial space;

said rotor (42) being rotatably disposed within said stator housing (38) for rotating in a first direction with said vanes (46) simultaneously compressing the working fluid in said chambers (48, 50): from said compression chamber inlet (52) to said compression chamber outlet (54) and expanding the fluid in said chambers (48, 50) from said expansion chamber inlet (56) to said expansion chamber outlet (58); and at least two of said ports being located opposite one another on respective said longitudinal ends (40) of said stator housing (38), said ports being generally longitudinally aligned for continuously simultaneously communicating with the same one of said chambers (48, 50) wherein the working fluid entering the associated chamber (48, 5:0) through one of said ports urges the working fluid currently occupying the associated chamber (48, 50) axially outwardly out of said stator housing (38) through the other of said ports.

14. The positive displacement rotating vane-type device (36) as set forth in claim 13 further including a high-pressure side heat exchanger (72) fluidly adjoining said compression chamber outlet (54) and said expansion chamber inlet (56).

15. The positive displacement rotating vane-type device (36) as set forth in claim 13 further including a low-pressure side heat exchanger (74) fluidly adjoining said expansion chamber outlet (58) and said compression chamber inlet (52).

16. The positive displacement rotating vane-type device (36) as set forth in claim 13 wherein said generally longitudinally aligned ports are said compression chamber inlet (52) and said expansion chamber outlet (58).

17. The positive displacement rotating vane-type device (36) as set forth in claim 13 wherein said generally longitudinally aligned ports are said compression chamber outlet (54) and said expansion chamber inlet (56).

18. The positive displacement rotating vane-type device (36) as set forth in claim 13 wherein said expansion chamber inlet (56) is disposed in a target space (22) for receiving air from the target space (22) and said compression chamber outlet (54) is disposed in the target space (22) for discharging the air back into the target space (22).

19. The positive displacement rotating vane-type device (36) as set forth in claim 13 wherein said stator housing (38) has a generally cylindrical shape.

* * * * *

UNITED STATES PATENT AND TRADEMARK OFFICE

CERTIFICATE OF CORRECTION

PATENT NO. : 8,596,068 B2
APPLICATION NO. : 12/917064
DATED : December 3, 2013
INVENTOR(S) : Gilbert S. Staffend It is certified that error appears in the above-identified patent and that said Letters Patent is hereby corrected as shown below:

In the Claims:

In Claim 5
Line 2 (Column 13, line 38), change “vale-type” to --vane-type--.
In Claim 6
Line 4 (Column 13, line 45), change “expansion Chambers” to --expansion chambers--.
In Claim 8
Line 19 (Column 14, line 2), change “(48: 50)” to --(48, 50)--.
In Claim 11
Line 1 (Column 14, line 47), change “cooling a, space” to --cooling a space--.
In Claim 13
Line 16 (Column 15, line 1), change “outlet, (54)” to --outlet (54)--.
Line 23 (Column 15, line 8), change “(48, 50): from” to --(48, 50) from--.
Line 34 (Column 15, line 19), change “5:0) through” to --50) through--.

Signed and Sealed this
Eighteenth Day of February, 2014

Michelle K. Lee

Michelle K. Lee
*Deputy Director of the United States Patent and Trademark Office*

UNITED STATES PATENT AND TRADEMARK OFFICE
Certificate

Patent No. 8,596,068 B2 Patented: December 3, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gilbert Staffend, Farmington, MI (US); and Nancy A. Staffend, Haslett, MI (US).

Signed and Sealed this Twenty-seventh Day of May 2014.

THOMAS DENION
*Supervisory Patent Examiner*
Art Unit 3748
Technology Center 3700